US007685757B2

(12) United States Patent
Rohrauer

(10) Patent No.: US 7,685,757 B2
(45) Date of Patent: Mar. 30, 2010

(54) RIFLE

(75) Inventor: Hermann Rohrauer, Molln (AT)

(73) Assignee: STEYR MANNLICHER Holding GmbH, Kleinraming (AT)

( * ) Notice: Subject to any disclaimer, the term of this patent is extended or adjusted under 35 U.S.C. 154(b) by 0 days.

(21) Appl. No.: 12/066,662

(22) PCT Filed: Jul. 5, 2006

(86) PCT No.: PCT/AT2006/000288

§ 371 (c)(1),
(2), (4) Date: Mar. 13, 2008

(87) PCT Pub. No.: WO2007/030844

PCT Pub. Date: Mar. 22, 2007

(65) Prior Publication Data

US 2008/0216377 A1 Sep. 11, 2008

(30) Foreign Application Priority Data

Sep. 14, 2005 (AT) ..... A 1513/2005

(51) Int. Cl.
*F41A 21/00* (2006.01)

(52) U.S. Cl. ..... 42/75.01; 42/75.02; 42/75.03; 42/75.04

(58) Field of Classification Search ..... 42/75.01–75.04
See application file for complete search history.

(56) References Cited

U.S. PATENT DOCUMENTS

| | | | | |
|---|---|---|---|---|
| 1,928,871 | A * | 10/1933 | Swebilius | 42/16 |
| 2,155,498 | A * | 4/1939 | Laudensack | 42/75.01 |
| 2,205,982 | A * | 6/1940 | Klipsch | 42/75.01 |
| 2,610,426 | A * | 9/1952 | Emerson | 42/75.01 |
| 3,023,527 | A * | 3/1962 | Leek et al. | 42/71.01 |
| 3,183,617 | A * | 5/1965 | Ruger et al. | 42/75.02 |
| 3,739,515 | A * | 6/1973 | Koon, Jr. | 42/75.03 |
| 3,972,143 | A * | 8/1976 | Wild | 42/75.01 |
| 5,247,758 | A * | 9/1993 | Mason | 42/75.02 |
| 6,470,617 | B1 * | 10/2002 | Gregory et al. | 42/75.04 |
| 7,104,000 | B2 * | 9/2006 | Orth | 42/71.01 |
| 7,162,823 | B2 * | 1/2007 | Schoppman et al. | 42/75.01 |
| 2003/0150151 | A1 * | 8/2003 | Orth | 42/75.02 |
| 2005/0188584 | A1 * | 9/2005 | Orth | 42/71.01 |
| 2005/0229463 | A1 * | 10/2005 | Tashjian | 42/75.02 |
| 2007/0186458 | A1 * | 8/2007 | Wait | 42/75.02 |
| 2008/0190005 | A1 * | 8/2008 | Rohrauer | 42/75.01 |

FOREIGN PATENT DOCUMENTS

| | | |
|---|---|---|
| DE | 38 28 022 | 2/1990 |
| EP | 0 157 515 | 10/1985 |
| EP | 1 345 001 | 9/2003 |

* cited by examiner

*Primary Examiner*—Troy Chambers
*Assistant Examiner*—Samir Abdosh
(74) *Attorney, Agent, or Firm*—Hoffmann & Baron, LLP

(57) ABSTRACT

A rifle comprising a housing, a barrel anchored thereon and a forearm extending below the barrel. The barrel is anchored by a fastening element which extends through a cross hole of the housing. The forearm has at least one axial projection that detachably engages into a seat of the housing. The cross hole for anchoring the barrel and the seat for fastening the forearm intersect and the forearm comprises a snap-in recess for the fastening element to snap in when the barrel is anchored.

9 Claims, 3 Drawing Sheets

RIFLE

BACKGROUND OF THE INVENTION

The present invention relates to a rifle having a housing, a barrel anchored on it and a fore-end extending under the barrel, in which case the barrel can be anchored with the aid of an attachment means which passes through a lateral hole in the housing, and the fore-end has at least one axial projection which engages detachably in a holder in the housing.

Rifles with an interchangeable fore-end allow different fore-ends to be used for different purposes, for example one fore-end with a bipod which can be unfolded for sniper use, a slim fore-end for hunting use, etc.

It is known, for detachable attachment of the fore-end for the axial projection to be equipped with sprung latching tabs which can be pulled back by a mechanism inside the fore-end in order to hold the fore-end. This design is rather complex to manufacture and is susceptible to defects during use.

The invention is based on the object of providing a simple, safe and reliable design for quick replacement of the fore-end, which at the same time ensures that the fore-end is anchored without play.

SUMMARY OF THE INVENTION

The foregoing object is achieved by a rifle of the type mentioned initially wherein, according to the invention, the lateral hole for barrel anchorage and the holder for fore-end attachment cross one another, and the projection has a latching recess for the attachment means to engage in, in a latching manner, when the barrel is in the anchored state.

In this way, the attachment means that is used to anchor the barrel is at the same time used for attachment of the fore-end. There is therefore no need for complicated latching and spring mechanisms in the fore-end and/or housing, because the fore-end is gripped at the same time that the barrel is anchored.

One preferred embodiment of the invention is distinguished in that the attachment means is a screw with a broadened head which, in the position in which it completely anchors the barrel, engages in the latching recess in the projection while in contrast releases the latching recess in an only partially screwed-in position. The fore-end can therefore be removed when the screw is in an intermediate position in which the barrel is still—loosely—connected to the housing, without having to remove the barrel and/or the attachment means itself or themselves from the housing. This represents a simple and effective type of captive security.

It is particularly advantageous, according to a further feature of the invention, for the fore-end to have two axial projections with mutually facing latching recesses, between which the attachment means passes. This allows forces to be introduced symmetrically while making the anchorage even stronger.

In any case, it is particularly advantageous for the fore-end to have an inner mount and a grip part surrounding it, with the projections being in the form of an integral extension of the inner mount. This results in the structure of the fore-end being particularly robust.

In this case, it is particularly advantageous for the inner mount to be made of metal or plastic, and for the grip part to be made of plastic or wood. Depending on the operational requirements, this allows particularly advantageous, or alternatively particularly load-resistant, composite structures to be provided for the fore-end.

BRIEF DESCRIPTION OF THE DRAWINGS

The invention will be explained in more detail in the following text with reference to one exemplary embodiment which is illustrated in the attached drawings, in which.

DETAILED DESCRIPTION

Figure 1:
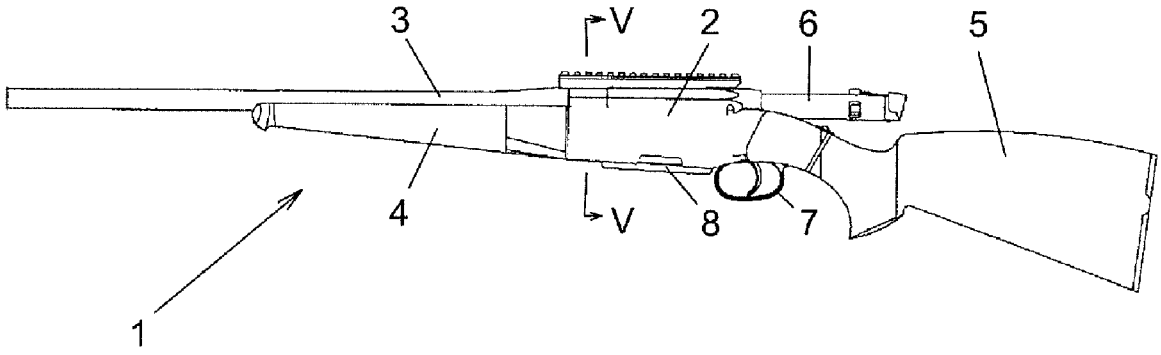
FIG. 1 shows a side view of the rifle according to the invention.

FIG. 1 shows a rifle 1 with a housing 2, a barrel 3, a fore-end 4 which extends under the barrel 3, and a conventional rear stock 5. The housing 2 holds a breech 6, a trigger device 7 and a magazine 8, and produces the force connection between all the components, as is known from the prior art. The housing 2 may comprise a central mount and side stock pieces 2' (FIGS. 1 and 5).

Figure 3:
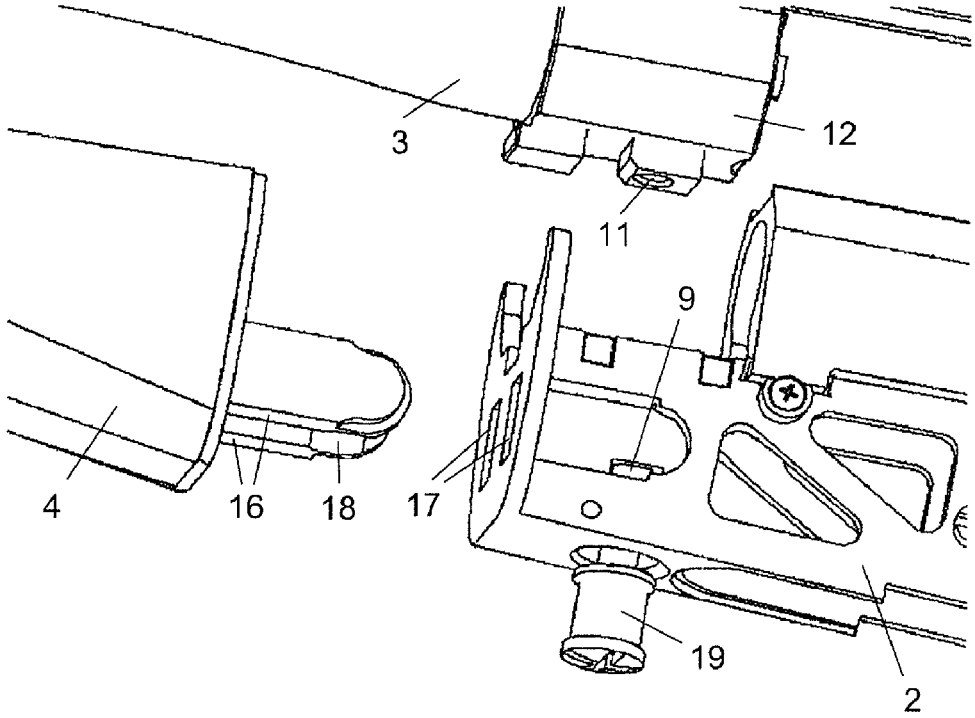
FIGS. 3 and 4 show the connection of the barrel and fore-end to the housing, in the form of detail perspective views, firstly before (FIG. 3) and secondly after (FIG. 4) connection.
Figure 4:
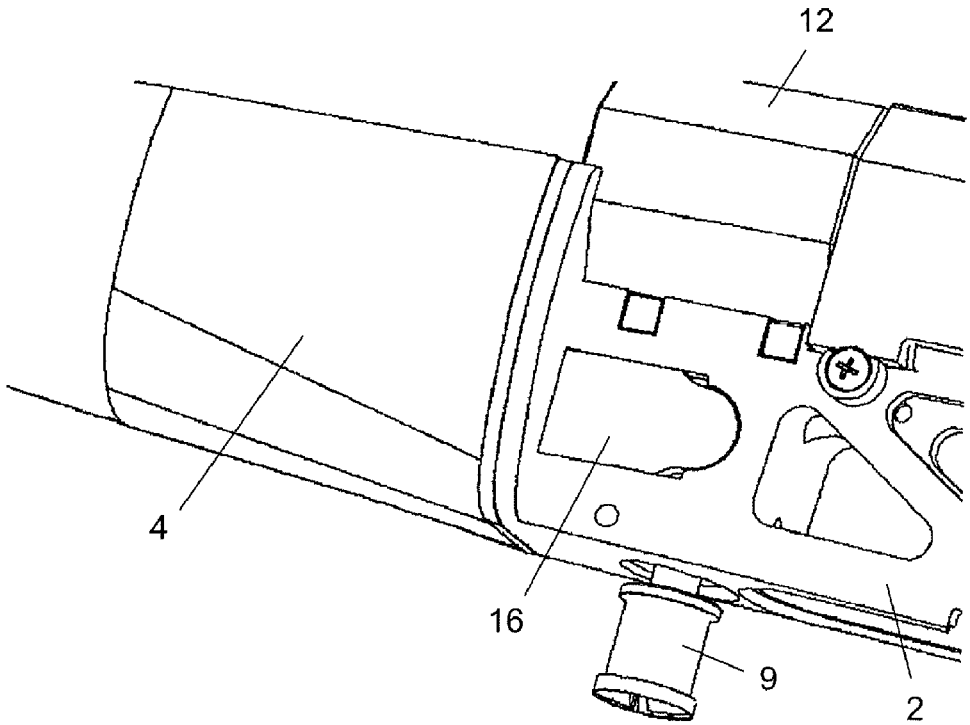
Figure 5:
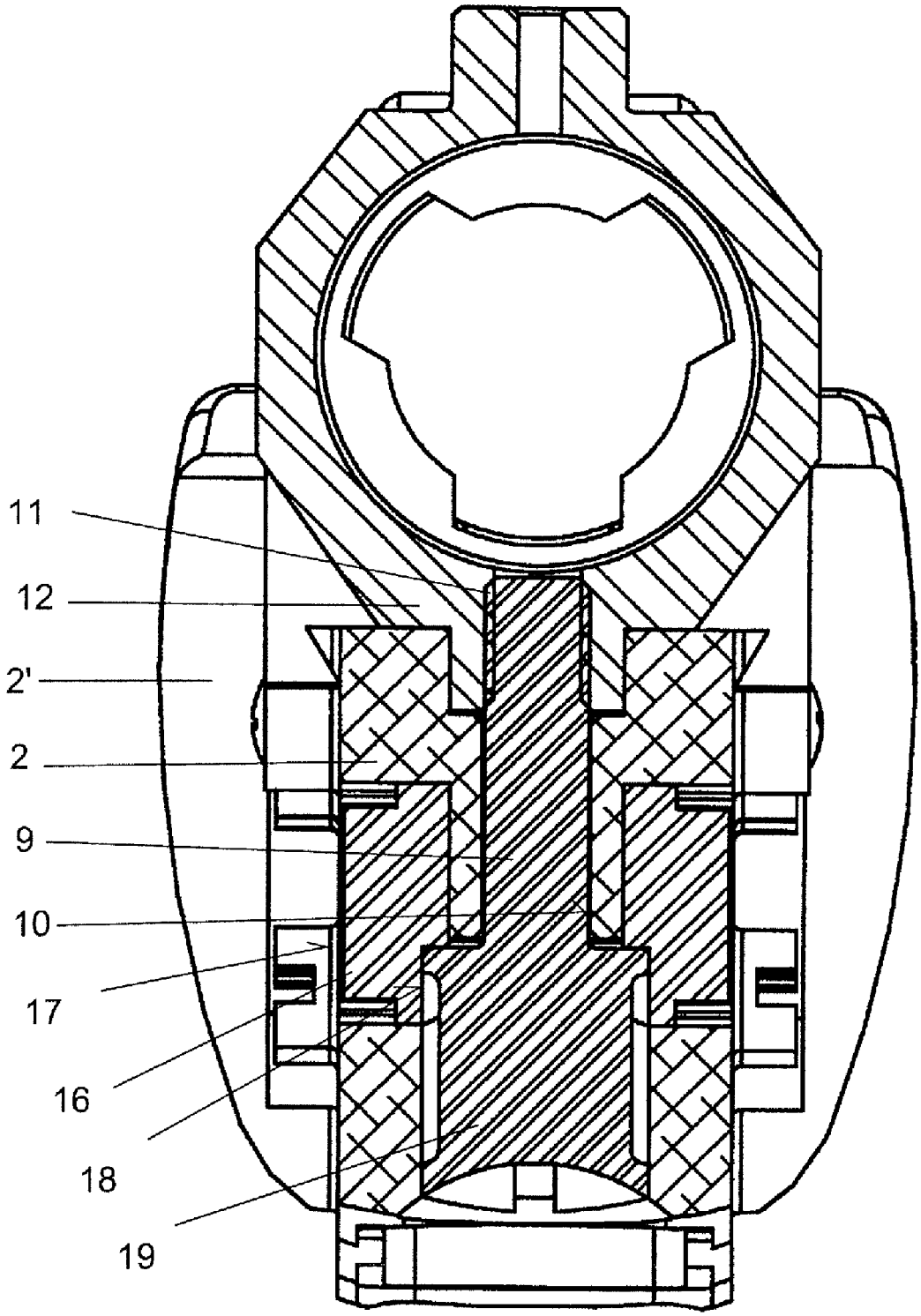
FIG. 5 shows a cross section along the section line V-V from FIG. 1.

As shown in FIGS. 3 to 5, the barrel 3 is detachably anchored on the housing 2 by means of an attachment means in the form of a screw 9. For this purpose, the screw 9 passes through a vertical lateral hole 10 in the housing 2 and engages in a corresponding thread 11 in the root 12 of the barrel 3.

Figure 2:
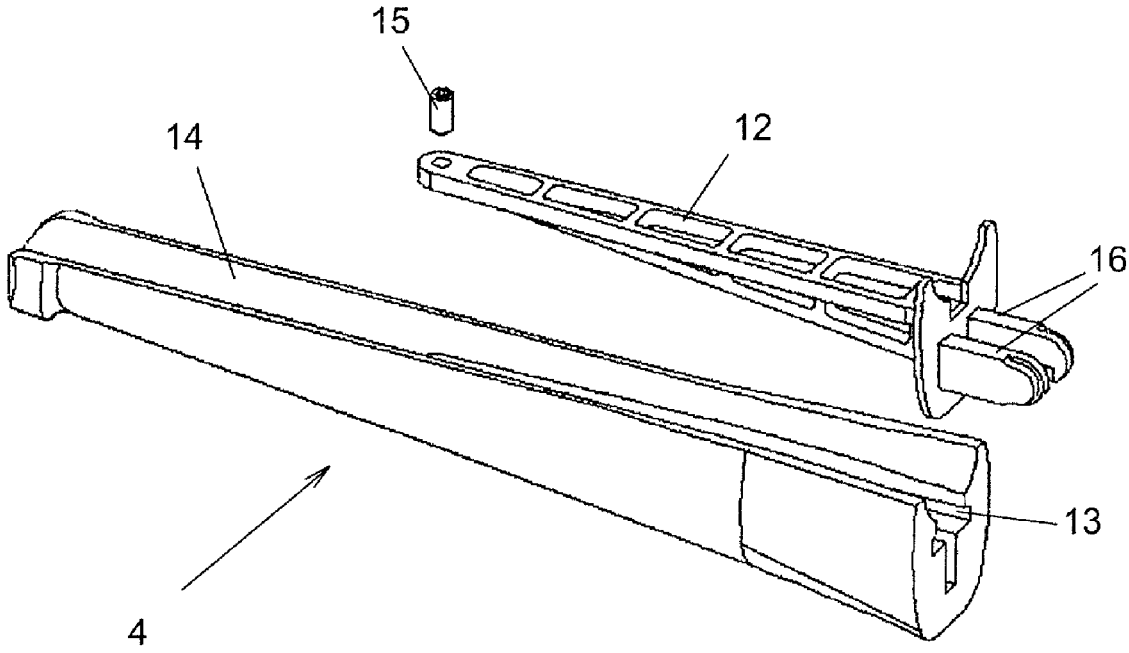
FIG. 2 shows an exploded perspective view of the fore-end according to the invention.

FIG. 2 shows a detail view of the design of the fore-end 4. The fore-end 4 has an inner mount 12 composed of plastic or metal, for example aluminum. The inner mount 12 is pushed into an axial groove 13 in a surrounding grip part 14, for example composed of plastic or wood, where it is fixed axially with the aid of a grub screw 15.

The inner mount 12 is lengthened in the form of two axially protruding projections 16 on its side facing the housing 2. The projections 16 engage in the axial direction in two slotted holders 17 in the housing 2 (FIG. 3).

The holders 17 and the lateral hole 10 cross in the housing 2. The projections 16 have mutually facing latching recesses 18, and the screw 9 has a broadened head 19 which, when the barrel 3 is in the anchored state (FIG. 5), engages in the latching recesses 18 and thus locks the projections 16 in the housing 2.

As shown in FIG. 5, the length over which the head 19 engages in the latching recesses 18 is shorter than the length over which the screw 9 engages in the thread 11, so that, when the screw 9 is partially screwed out, the latching recesses 18 are disengaged first, allowing the fore-end 4 to be pulled out even before the barrel 3 can be completely detached from the housing 2.

The invention is not restricted to the embodiments described, but covers all variants and modifications which are within the scope of the attached claims.

The invention claimed is:

1. A rifle comprising a housing, a barrel anchored on the housing and a fore-end extending under the barrel, the barrel and fore-end being anchorable to the housing by an attachment means which passes through a lateral hole in the housing, wherein the fore-end has at least one axial projection detachably slidable into a corresponding receptacle formed in the housing, wherein the lateral hole for barrel anchorage and the receptacle for receiving the fore-end projection cross one another to form a common opening in the housing, and the axial projection of the fore-end has a latching recess in which the attachment means engages, whereby when the barrel is anchored to the housing by the attachment means passing through the lateral hole, the fore-end is, at the same time, anchored to the housing by the attachment means engaging the latching recess.

2. The rifle as claimed in claim 1, the attachment means is a screw with a broadened head which, when in the position where the barrel is anchored, engages in the latching recess in the axial projection and wherein the fore-end can be removed when the screw is in an intermediate position in which the barrel is loosely coupled to the housing.

3. The rifle as claimed in claim 1, wherein the fore-end has two axial projections with mutually facing latching recesses, between which the attachment means passes.

4. The rifle as claimed in claim 2, wherein the fore-end has an inner mount and a grip part surrounding it, wherein the axial projection comprises an integral extension of the inner mount.

5. A rifle comprising a housing, a barrel anchored on the housing and a fore-end extending under the barrel, the barrel is anchorable with the aid of an attachment means which passes through a lateral hole in the housing, and the fore-end has an axial projection which engages detachably in a holder in the housing, the lateral hole for barrel anchorage and the holder for fore-end attachment cross one another, and the axial projection has a latching recess in which the attachment means engages, in a latching manner, when the barrel is in the anchored state, wherein the fore-end has an inner mount and a grip part surrounding it, wherein the axial projection comprises an integral extension of the inner mount.

6. A rifle comprising a housing, a barrel anchored on the housing and a fore-end extending under the barrel, the barrel is anchorable with the aid of an attachment means which passes through a lateral hole in the housing, and the fore-end has two axial projections which engage detachably in a hold in the housing, the lateral hole for barrel anchorage and the holder for fore-end attachment cross one another, and the two axial projections have a latching recess between which the attachment means passes, in a latching manner, when the barrel is in the anchored state.

7. The rifle as claimed in claim 5, wherein the inner mount is made of one of metal and plastic, and the grip part is made of one of plastic and wood.

8. The rifle as claimed in claim 1, wherein the fore-end is removable from the housing when the barrel remains loosely attached to the housing by the attachment means.

9. The rifle as claimed in claim 1, wherein the fore-end has an inner mount and a grip part surrounding it, and wherein the axial projection comprises an integral extension of the inner mount.

* * * * *